United States Patent [19]

Brajituli

[11] 3,936,202

[45] Feb. 3, 1976

[54] RING BINDER

[76] Inventor: Peter Brajituli, Arguelles, 21, Oviedo, Spain

[22] Filed: Feb. 24, 1975

[21] Appl. No.: 552,124

[52] U.S. Cl. ..... 402/24; 281/33; 402/80 R

[51] Int. Cl.[2] ..... B42F 13/00

[58] Field of Search ..... 281/3, 15 R, 33, 37; 282/8 R, 29 B; 402/24, 31, 80 R, 80 L

[56] References Cited

UNITED STATES PATENTS

| | | | |
|---|---|---|---|
| 1,840,743 | 1/1932 | Schade | 402/80 R |
| 2,613,956 | 10/1952 | Ericson | 281/33 |
| 2,739,826 | 3/1956 | Triebel | 282/8 R |
| 3,620,553 | 11/1971 | Donovan | 402/80 R |

FOREIGN PATENTS OR APPLICATIONS

| | | | |
|---|---|---|---|
| 15,890 | 1909 | United Kingdom | 402/80 R |
| 679,876 | 8/1939 | Germany | 282/8 R |

*Primary Examiner*—Jerome Schnall
*Attorney, Agent, or Firm*—Young & Thompson

[57] ABSTRACT

A loose leaf ring binder has a support for holding up the inner edges of the loose leaf sheets on that side of the rings on which it would be difficult to write. The support is a flat relatively rigid sheet that is swingably connected at its inner or outer edge to one of the binder covers, so that the inclination of the support can be adjusted. Means are provided for maintaining the selected inclination of the support, in the form of a series of teeth on the adjacent outer cover with means on the support selectively engaging with the teeth to adjust the position of the support so as to bring the inner edge of the supported loose leaf substantially level with the rings. The cover can be quite narrow, in the form of a flexible strap secured at one end to the spine of the binder and coacting with the support at its other end.

4 Claims, 6 Drawing Figures

FIG. 1
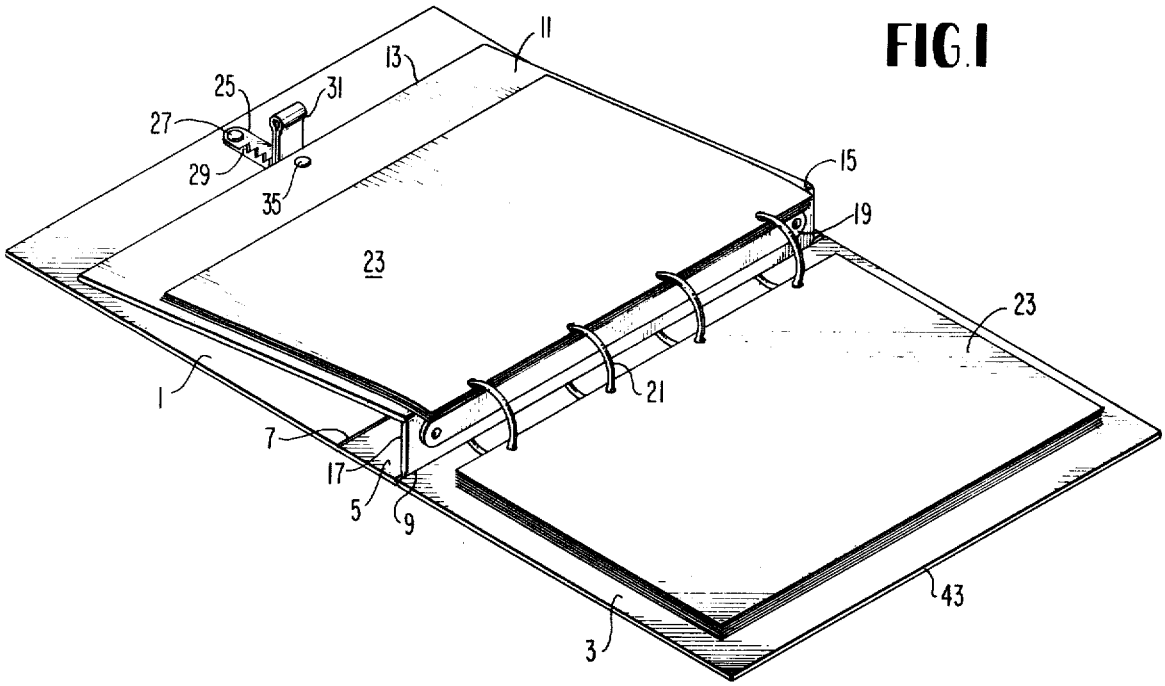
FIG. 2
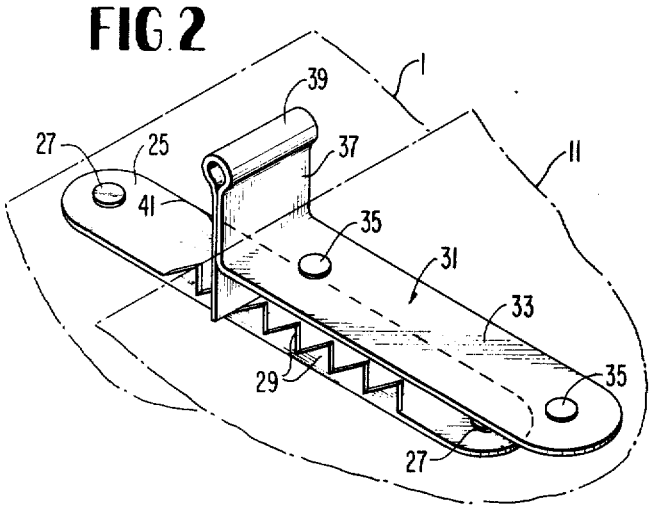
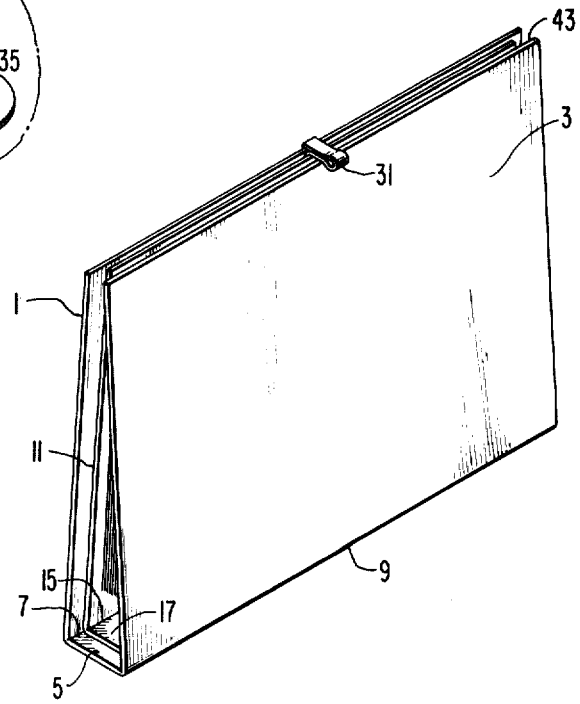
FIG. 3

FIG. 4
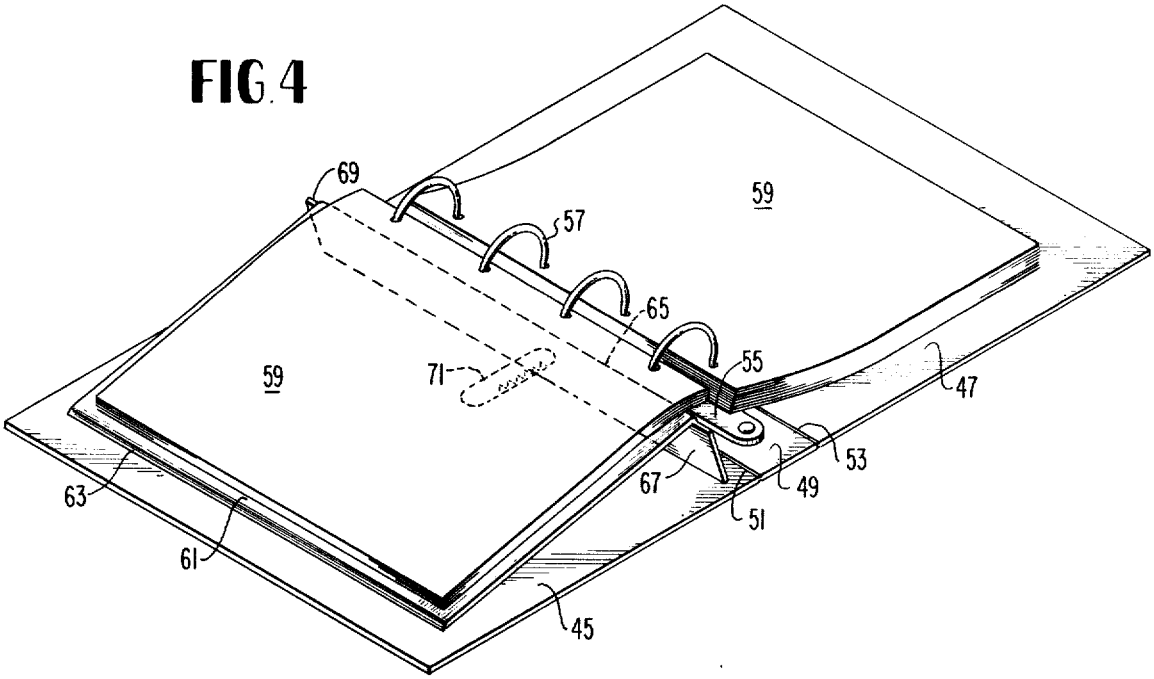
FIG. 5
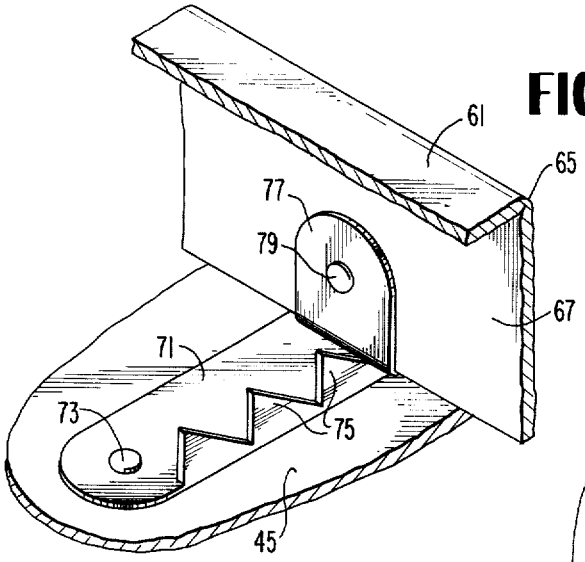
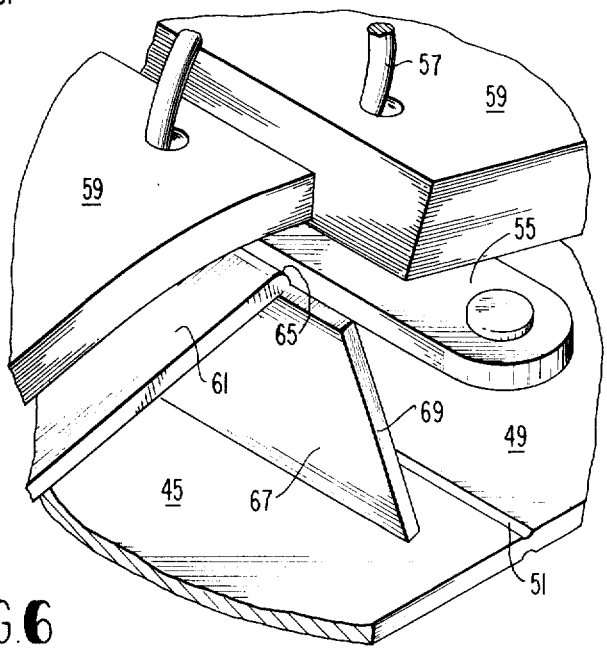
FIG. 6

RING BINDER

The invention relates to ring binders, in which a plurality of leaves which are ordinarily paper sheets or pages are releasably or permanently secured by the rings, for example as in a notebook.

Such ring binders suffer the disadvantage that, when it is attempted to write on both sides of the paper, the rings interfere with the writer's hand on one side of the rings. For example, when the binder is open and the pages lie on both sides of the rings, then a right-handed writer can easily write on the pages that lie to the right of the rings; but when he attempts to write on the pages to the left of the rings, the rings interfere with the movements of his writing hand when he approaches the ends of the lines. The same is true for left-handed writers, who experience this difficulty on the pages that lie to the right of the rings.

Accordingly, it is an object of the present invention to provide a ring binder having means to avoid interference between the rings and the hand of the writer on either side of the rings.

Another object of the present invention is the provision of a ring binder in which the position of the pages relative to the rings can be adjusted as desired.

Finally, it is an object of the present invention to provide a ring binder, which will be relatively simple and inexpensive to manufacture, easy to manipulate, and rugged and durable in use.

Other objects, features and advantages of the present invention will become apparent from a consideration of the following description, taken in connection with the accompanying drawing, in which:

FIG. 1 is a perspective view of an open loose leaf ring binder according to a first embodiment of the present invention;

FIG. 2 is an enlarged fragment of FIG. 1 with the cover and support indicated only in phantom lines so as better to illustrate the relationship of the parts;

FIG. 3 is a perspective view of the binder of FIG. 1 in its closed position;

FIG. 4 is a view similar to FIG. 1 but showing a second embodiment of the invention;

FIG. 5 is an enlarged fragment of FIG. 4 with parts broken away for clarity; and FIG. 6 is another enlarged fragment of FIG. 4 at one end of the spine of the binder.

Referring now to the drawings in further detail, and first to the embodiment of FIG. 1, there is shown a loose leaf ring binder according to the present invention, comprising a pair of covers 1 and 3 which are swingably interconnected with a central spine 5 along fold lines 7 and 9, respectively. A support 11 has a free outer edge 13 and at its inner edge has a fold line 15 by which it is swingably connected to an inner spine 17 which in turn is swingably connected to the binder along fold line 9. Covers 1 and 3 and support 11 and spines 5 and 17 are preferably of conventional rigid or semirigid notebook or binder material, e.g. fiberboard, which may if desired be covered with conventional cloth and/or plastic sheeting to render them more durable and possibly even weatherproof. Such covering provides the required flexible connection at fold lines 7, 9 and 15. As to rigidity, it is more important that support 11 and inner spine 17 should be rigid than that covers 1 and 3 and spine 5 be rigid, which latter can have a conventional degree of flexibility.

Fixedly mounted on inner spine 17 is a conventional ring support 19 for supporting a plurality of conventional axially aligned rings 21, which rings releasably retain a plurality of punched loose leaf pages 23. Ring support 19, rings 21 and pages 23 can be entirely conventional and so need not be discussed in greater detail. They can be of the type in which the rings 21 are half rings that open and close with a snap action, or other known types of rings. When speaking of "rings" in this specification, it will of course be understood that the term is used in its broadest sense and does not necessarily imply circular rings. Squared rings and other conventional forms are comprehended within the term. Therefore, the term "rings" as used herein is broad enough to cover all forms of upstanding members on the interior of binders which interfere with one or the other of the hands of the writer during writing on at least one side of the upstanding members termed "rings." However, the term "rings" implies that the pages are able to move relative to the rings sufficiently that the pages will lie flat on either side of the rings rather than being rigidly clamped in such a way as would require bending of the page in order to write on both sides thereof.

Secured to the mid-portion of the inner surface of the cover 1, adjacent but perpendicular to the outer edge thereof, is a flat metal strip 25 secured at its ends by rivets 27 to cover 1 and having a series of upstanding teeth 29 along one edge thereof. A detent 31 comprises a base portion 33 in the form of a strip secured by rivets 35 to the underside (in the FIG. 1 position) of the support 11 midway of the length of the free edge 13 thereof, as seen in FIG. 2. Base portion 33 terminates endwise outwardly in a perpendicular upstanding leg 37 having an enlarged bend 39 at its upper end (referring to the orientation of FIGS. 1 and 2) by which it is connected to a leg 41 that extends parallel to leg 37 and terminates downwardly (again with respect to the FIGS. 1 and 2 orientation) in a free end that is below the under surface (referring to FIG. 1) of the cover 11. Detent 31 is a single metal strip bent to have these various portions.

The strip 25 and detent 31 coact to maintain the parts in any desired adjusted position, for example that of FIG. 1. Thus, in operation, with the binder open in the FIG. 1 position, and pages 23 lying on both sides of rings 21, it is convenient for a right-handed person to write on the pages 23 to the right of the rings 21; but when he attempts to write on those to the left of the rings, the rings 21 interfere with the free movements of his hand when he reaches the right ends of the lines. But thanks to the support 11 and inner spine 17, these pages 23 to the left of rings 21 can be elevated at their inner edges util the inner edges are substantially coplanar with the uppermost parts of the rings 21. This is done by raising the support 11 above the cover 1, the support 11 and spine 17 folding about the fold line 15 and the spine 17 and cover 3 folding about the fold line 9. This raised position of the support 11 is maintained by engagement of the free lower end of leg 41 between an appropriate pair of teeth 29.

But suppose the writer is left-handed. He can easily write on the pages to the left of the rings 21; but when he has to write on the pages to the right of the rings 21, the rings interfere with his writing hand. Nevertheless, the same binder is useful to him, with no modification other than to turn it upside down, so that the support 11 is now to the right of the rings 21 and the above procedure is carried out as before.

By disengaging the detent 31 from the teeth 29, the support 11 and spine 17 can be laid flat against the cover 1 and spine 5 so that the binder can be closed to the FIG. 3 position. For this purpose, it is preferred that the spine 17 be a bit narrower than the spine 5 so that the fold lines 7 and 15 will substantially overlie each other in the closed binder position of FIG. 3.

Notice also in the closed binder position of FIG. 3 that the detent 31 now performs a second function: the enlarged bend 39 snaps over the free edge 43 of the cover 3 thereby releasably to retain the support 11 and the cover 3 in closed position thereby further to protect the pages 23 that are between them. Of course, in this closed position, the cover 1 is free to fall open; but its opening exposes none of the pages.

The embodiment of FIGS. 4–6 is generally similar to that of FIGS. 1–3, except that the support is pivoted to the cover at its opposite or outer edge. Thus, in FIG. 4, a binder is provided comprising covers 45 and 47 swingably interconnected to a spine 49 along fold lines 51 and 53. A conventional ring support 55 supports a plurality of conventional axially aligned rings 57, the ring support 55 in this embodiment being fixedly secured directly to the outer spine 49, because in this embodiment there is no inner spine corresponding to the spine 17 of FIG. 1.

The pages 59 are releasably retained by rings 57 in the conventional manner, those to the left of the rings in this embodiment being supported by a support 61 which, as indicated above, is hinged to the cover 45 along its outer edge by hinge 63. The hinge may be a cloth hinge or metal hinge or other appropriate hinge, and may be continuous or discontinuous as desired. For simplicity of construction, as also in the preceding embodiment, it is preferred that the same material that covers the boards of the covers and the support comprise the hinge at 63.

Support 61 terminates at its inner edge in a fold line 65 by which it is connected to a long narrow flap 67 which, like support 61, is of substantially rigid material. Flap 67 is longer than fold line 65 and extends endwise beyond support 61 at the top and bottom in the form of extensions 69 which provide finger pieces for the adjustment of the support 61 by folding flap 67 about fold line 65 to various angles relative to support 61.

In order to retain the adjusted position of flap 67 relative to support 61, thereby to predetermine the degree of elevation of support 61, a flat metal strip 71 is secured to the inner side of cover 45 by rivets 73, strip 71 extending midway of the length of the inner edge of cover 45 and perpendicular to that edge and having its inner edge disposed quite close to fold line 51. Strip 71 has a series of upstanding teeth 75 extending along one edge thereof, between which the lower edge of flap 67 is selectively received; and to reduce the wear on this lower edge of flap 67 which would otherwise be caused by teeth 75, a reinforcement 77 is provided in the form of a U-shaped metal tab that extends on both sides of the lower edge of flap 67 and is secured thereto by a rivet 79.

The embodiment of FIG. 4 is in all other respects used in the same manner as that of FIG. 1: the extensions 69 are grasped and the flap 67 is manipulated whereby the support 61 is adjusted in inclination until the pages 59 on the left of the rings 57 are substantially coplanar with the tops of the rings 57. Reinforcement 77 between teeth 75 holds this adjusted position. To close the binder, the flap 67 is disengaged from the teeth 75 and is folded under the inner edge of support 61 and lies flat against the underside of support 61. The support 61 then lies almost flat against cover 45, after which covers 45 and 47 can be closed together in the usual way.

It will of course be recognized that the covers 1 and 45 serve principally to support their respective metal strips 25 and 71. This function can be equally well performed by a relatively narrow flexible strap (not shown) secured at one end to the spine and carrying the metal strip 25 or 71 at an appropriate point along its length. Therefore, the term "cover" as used in the appended claims also includes such straps.

From a consideration of the foregoing disclosure, therefore, it will be evident that all the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described my invention, I claim:

1. A ring binder comprising a pair of covers, a plurality of rings carried by the binder for retaining punched pages thereon between the covers, an outer spine disposed between and swingably connected to both of said covers, an inner spine overlying said outer spine when said binder is opened flat, said inner spine being pivotably connected to said binder at one edge, a support on at least one a substantially rigid sheet swingably connected at one of its edges to the other edge of said inner spine and free at its opposite edge, said rings being mounted on said inner spine, and means to adjust the elevation of the inner edge of said support relative to the rings whereby when the covers of the binder are open, the inner edges of pages resting on the first-mentioned inner edge will be at about the same level as the upper portions of the rings, said adjusting means comprising a series of teeth on the inner side of one said cover, said series extending in a direction perpendicular to said edges, and a detent on said free edge of said sheet and selectively edngageable between any adjacent pair of said teeth.

2. A binder as claimed in claim 1, said sheet being pivotally connected to said binder at its edge adjacent said rings.

3. A binder as claimed in claim 1, and means engageable with the free edge of the other said cover releasably to retain said sheet and said other cover closed with said pages between them.

4. A binder as claimed in claim 1, said rings opening and closing to release and retain said pages.

* * * * *